US009597721B2

(12) United States Patent
Allwood et al.

(10) Patent No.: US 9,597,721 B2
(45) Date of Patent: Mar. 21, 2017

(54) SPIN FORMING PROCESS AND APPARATUS FOR MANUFACTURING ARTICLES BY SPIN FORMING

(75) Inventors: Julian M. Allwood, Cambridge (GB); Omer Music, Sarajevo (BA)

(73) Assignee: CAMBRIDGE ENTERPRISE LIMITED, Cambridge (GB)

( * ) Notice: Subject to any disclaimer, the term of this patent is extended or adjusted under 35 U.S.C. 154(b) by 350 days.

(21) Appl. No.: 13/819,611

(22) PCT Filed: Sep. 29, 2011

(86) PCT No.: PCT/GB2011/001424

§ 371 (c)(1),
(2), (4) Date: Feb. 27, 2013

(87) PCT Pub. No.: WO2012/042221

PCT Pub. Date: Apr. 5, 2012

(65) Prior Publication Data

US 2013/0152652 A1 Jun. 20, 2013

(30) Foreign Application Priority Data

Oct. 1, 2010 (GB) ..... 1016611.4

(51) Int. Cl.
*B21D 22/16* (2006.01)
*B21D 22/18* (2006.01)
*B21D 22/14* (2006.01)

(52) U.S. Cl.
CPC ..... *B21D 22/16* (2013.01); *B21D 22/14* (2013.01); *B21D 22/18* (2013.01); *B21D 22/185* (2013.01)

(58) Field of Classification Search
CPC ..... B21D 22/14; B21D 22/16; B21D 22/185; B21D 22/18
USPC ..... 72/80–87
See application file for complete search history.

(56) References Cited

U.S. PATENT DOCUMENTS

| | | | | |
|---|---|---|---|---|
| 2,395,324 A | | 6/1943 | Grotnes | |
| 3,372,567 A | * | 3/1968 | Jensen et al. | 72/80 |
| 3,783,665 A | * | 1/1974 | Ashizawa | 72/81 |
| 4,038,850 A | | 8/1977 | Sakagami | |

(Continued)

FOREIGN PATENT DOCUMENTS

| | | |
|---|---|---|
| DE | 4818792 | 10/1951 |
| DE | 1552178 | 9/1970 |

(Continued)

OTHER PUBLICATIONS

English Translation of the Office Action for corresponding Japanese Application No. 2013-530794 dated Jun. 9, 2015.

(Continued)

*Primary Examiner* — David B Jones
(74) *Attorney, Agent, or Firm* — Swanson & Bratschun, L.L.C.

(57) ABSTRACT

A spin forming process and apparatus is disclosed. A workpiece (e.g. sheet metal) is rotated with respect to a forming roller which bears against one of the outer and inner surfaces of the workpiece to deform the workpiece towards a required shape. First and second support rollers bears against the opposite surface of the workpiece. Computer control of the positions of the forming roller and the first and second support rollers allow non-axisymmetric shapes to be manufactured by spin-forming.

23 Claims, 15 Drawing Sheets

(56) References Cited

U.S. PATENT DOCUMENTS

| | | | | |
|---|---|---|---|---|
| 4,766,752 | A | 8/1988 | Gronert | |
| 5,228,321 | A | 7/1993 | Shibasaka | |
| 5,426,964 | A * | 6/1995 | Sieger | 72/81 |
| 5,979,203 | A | 11/1999 | Radocaj | |
| 7,131,304 | B2 | 11/2006 | Arai | |
| 7,584,636 | B2 | 9/2009 | Arai | |
| 2005/0183484 | A1 | 8/2005 | Arai | |
| 2005/0257588 | A1 | 11/2005 | Lancaster | |
| 2008/0022741 | A1 | 1/2008 | Arai | |
| 2009/0174197 | A1* | 7/2009 | Pascual et al. | 293/102 |

FOREIGN PATENT DOCUMENTS

| | | | |
|---|---|---|---|
| DE | 3545506 | | 6/1992 |
| GB | 1202144 | | 8/1970 |
| GB | 1293017 | A | 10/1972 |
| GB | 2184676 | A | 7/1987 |
| JP | 35-027447 | | 10/1960 |
| JP | 55075821 | A | 6/1980 |
| JP | 2007-014983 | | 1/2007 |
| WO | WO 02/070152 | | 9/2002 |
| WO | WO 2004/030843 | | 4/2004 |

OTHER PUBLICATIONS

English Machine Translation of the third party observation for the corresponding European Application dated Jul. 16, 2013.

O. Music, J.M. Allwood, K. Kawai "A review of the mechanics of metal spinning" Journal of Materials Processing Technology 210 (2010) 3-23.

International Search Report dated Mar. 1, 2012, 9 pages.

UKIPO search report on GB 1016611.4 dated Oct. 29, 2010.

"Fertigungsverfahren Umformen", 5 Ed. 2006 (translation also included).

* cited by examiner

SPIN FORMING PROCESS AND APPARATUS FOR MANUFACTURING ARTICLES BY SPIN FORMING

RELATED APPLICATION DATA

The instant application is a national phase filed pursuant to 35 USC §371 of International Patent Application No. PCT/GB2011/001424, filed Sep. 29, 2011; which application claims priority to GB Application No. 1016611.4, filed Oct. 1, 2010; all of the foregoing applications are incorporated herein by reference in their entireties.

BACKGROUND TO THE INVENTION

Field of the Invention

The present invention relates to spin forming process and to apparatus for manufacturing articles by spin forming. The invention has particular, but not necessarily exclusive, application to metal spinning.

Related Art

Metal spinning refers to a group of forming processes that allow production of hollow, axially symmetric (axisymmetric) sheet metal components. The basic technique of spinning, which is common to this group of processes, consists of clamping a sheet metal blank against a mandrel on a spinning lathe, and gradually forming the blank onto the mandrel surface by a roller, either in a single step or series of steps.

A detailed review of academic literature related to spin forming has been carried out and disclosed by Music et at (2010) [O. Music, J. M. Allwood, K. Kawai "A review of the mechanics of metal spinning" Journal of Materials Processing Technology 210 (2010) 3-23], the entire content of which is hereby incorporated by reference.

It is of interest here to draw a distinction between the terms conventional spinning, shear spinning and tube spinning, all of which are considered to be spin forming processes. A common feature of the three processes is that they typically allow production of hollow, rotationally symmetric parts. The main difference between the three is apparent in the wall thickness of the formed part. In conventional spinning, the wall thickness remains nearly constant throughout the process, so the final wall thickness of the formed part is substantially equal to the thickness of the blank. In contrast, the wall thickness is reduced in shear spinning and tube spinning; in shear spinning, part thickness is dictated by the angle between the wall of the component and the axis of rotation; in tube spinning, the final thickness is defined by the increase in length of the workpiece. Furthermore, while in conventional spinning and tube spinning parts can be formed in a single step or a number of steps, in shear spinning, forming is done in a single step.

A conventional spinning process is illustrated in FIG. 1, in which initial sheet metal workpiece 10 is held in a metal spinning apparatus clamped between a tailstock 12 and a mandrel 14. The mandrel 14, sheet metal workpiece 10 and tailstock are rotatable about principal rotational axis A. The spinning sheet is pressed towards the mandrel 14 using roller 16, supported by roller arm 18 and rotatable about roller axis X. FIG. 2 shows examples of feasible geometries formable by known conventional metal spinning processes. All are axisymmetric, and as can be seen, the range of feasible axisymmetric shapes is relatively broad.

A shear spinning process is illustrated in FIG. 3. Initial sheet metal workpiece 20 has thickness $t_0$. Initial sheet metal workpiece 20 is held in a metal spinning apparatus clamped between a tailstock 22 and a mandrel 24. The mandrel 24, sheet metal workpiece 20 and tailstock are rotatable about principal rotational axis A. The spinning sheet 20*a* is pressed towards the mandrel 24 using roller 26, supported by roller arm 28. In the shear spinning process, the thickness of the metal workpiece is reduced substantially, to $t_1$, where $t_1<t_0$. In some shear spinning processes, the overall diameter of the workpiece (measured perpendicular to the axis A) is the same after the spinning process as before the spinning process. The limit of shear spinning is given by the minimum angle $\alpha$ that can be achieved in the finished geometry, where:

As $\alpha$ is decreased, the required reduction in wall thickness to achieve the required value for $\alpha$ becomes very significant, leading to failure of the workpiece where the required value for $\alpha$ is too low. FIG. 4 shows examples of feasible geometries formable by shear spinning processes.

Some workers have recognised that metal spinning is limited to the production of axisymmetric geometries. Therefore some work has been done to try to modify metal spinning processes in order to produce non-axisymmetric geometries.

For example. US 2005/0183484 discloses the use of a control system in order to control the pressing force of a roller tool against a workpiece where the mandrel has a non-axisymmetric geometry. During the process, the workpiece conforms to the outer shape of the mandrel. A similar process is set out in US 2008/0022741.

SUMMARY OF THE INVENTION

The inventors have recognised that although US 2005/0183484 and US 2008/0022741 may provide processes for the manufacture of articles with non-axisymmetric geometries, they suffer from the disadvantage that the specific required non-axisymmetric geometry must first be provided in the form of a shaped mandrel, before the metal spinning process is carried out. Although this may be acceptable where the mandrel will be used many times to produce many identically shaped articles, this process is inflexible in that even minor changes to the required geometry necessitates the manufacture of a new mandrel.

The present inventors recognise that a similar problem exists in relation to the manufacture of articles having axisymmetric geometries.

The present invention therefore seeks to address one or more of the above problems, and preferably ameliorates or even overcomes one or more of these problems.

In a general aspect in relation to spin forming, the present invention replaces a conventional mandrel with at least two supports for bearing against a surface of the workpiece, the workpiece being rotatable with respect to the two supports.

In a first preferred aspect, the present invention provides a spin forming process for manufacturing an article of a required shape from a workpiece, the workpiece having, with reference to the required shape of the article, an outer surface and an inner surface, wherein the workpiece is rotated with respect to a forming tool which bears against one of the outer and inner surfaces of the workpiece to deform the workpiece towards the required shape and a first support bears against one of the inner and outer surfaces of the workpiece, and a second support bears against one of the inner and outer surfaces of the workpiece, the workpiece rotating with respect to the supports.

In a second preferred aspect, the present invention provides an apparatus for manufacturing an article of a required shape from a workpiece by spin forming, the workpiece having, with reference to the required shape of the article, an outer surface and an inner surface, the apparatus having:

mounting means for rotatable mounting of the workpiece in the apparatus;

a forming tool for bearing against one of the outer and inner surfaces of the workpiece to deform the workpiece towards the required shape;

a first support for bearing against one of the inner and outer surfaces of the workpiece; and a second support for bearing against one of the inner and outer surfaces of the workpiece, wherein the apparatus is operable to allow the workpiece to rotate with respect to the first and second supports.

Preferred and/or optional features of the invention will now be set out. These are applicable singly or in any combination with any aspect of the invention, unless the context demands otherwise.

It is preferred that the workpiece is formed of metal. Any suitable workable metal may be used, e.g. steel, brass, aluminium (and/or its alloys), titanium (and/or its alloys), etc. However, it is possible to carry out spin forming using other workable starting materials, e.g. plastics materials such as PVC.

The workpiece is typically in sheet form. Thus, the inner and outer surfaces of the initial workpiece are designated by the orientation of the workpiece in the apparatus and by the required shape of the article to be formed.

The workpiece may have a uniform initial thickness. However, this is not necessarily essential, since spin forming processes can be carried out using workpieces of non-uniform initial thickness.

It is preferred, for at least some embodiments of the invention, that the spin forming process does not substantially change the thickness of the workpiece. Thus, with reference to the nomenclature introduced above, it is preferred that the spin forming process is a type of conventional spinning, rather than shear spinning.

It is possible to consider the angle between the inner surface of the workpiece and the rotational axis of the workpiece during the spin forming process. More generally (where this angle varies with position in the workpiece), it is possible to define an angle $\alpha$ as the angle between the rotational axis A of the workpiece and the tangent to the inner surface of the workpiece at a particular position, the tangent being drawn in a plane containing the rotational axis A of the workpiece. Where, at that particular position, the initial thickness of the workpiece is $t_0$ and the final thickness of the workpiece is $t_1$, it is preferred that the following inequality (1) is satisfied, for values of $\alpha$ less than 90°:

$$t_1 > t_0 \sin \alpha \qquad \text{inequality (1)}$$

Where inequality (1) is satisfied, the thickness of the workpiece after spin forming is greater than would be expected if the spin forming process was a shear spinning process.

At least at some positions on the article formed by spin forming, the angle $\alpha$ may be equal to or less than 45°, more preferably equal to or less than 40°, equal to or less than 35°, equal to or less than 30°, equal to or less than 25°, equal to or less than 20°, equal to or less than 15°, equal to or less than 10°, equal to or less than 5°, equal to or less than 0°, equal to or less than −10°, or equal to or less than −20°. Preferably, any one of these (imitations on the value of a may be satisfied for an area of the internal surface of the article corresponding to at least 5% of the total internal surface area of the article. More preferably, any one of these limitations on the value of a may be satisfied for an area of the internal surface of the article corresponding to at least 10%, at least 20%, at least 30% or at least 40% of the total internal surface area of the article.

The required shape of the article may be an axisymmetric shape. However, in some preferred embodiments, the required shape of the article may be a non-axisymmetric shape.

For example, considering the cross-sectional shape of the article, where the cross section is taken perpendicular to the rotational axis, the cross-sectional shape is typically non-circular. The shape may, for example, be elliptical, oval, regular curved shape, irregular curved shape, triangular, rectangular, regular polygonal, irregular polygonal, or any combination of these shapes (e.g. a generally curved shape including at least one straight wall portion, or a generally polygonal shape including at least one curved wall portion). In some embodiments, the cross-sectional shape (taken perpendicular to the rotational axis) includes a re-entrant portion. The angle $\alpha$ may vary around the perimeter of the cross sectional shape, e.g. by 5% or more.

Considering the cross sectional shape of the article where the cross section is taken along (or parallel) to the rotational axis, the shape can be considered in terms of the variation in the angle $\alpha$ with distance along the rotational axis. This variation may include at least a portion (e.g. at least 5% of the height of the article along the rotational axis) of linear variation of $\alpha$ with distance D along the rotational axis. Additionally or alternatively, this variation may include at least a portion (e.g. at least 5% of the height of the article along the rotational axis) where the first derivative $d\alpha/dD$ is positive or negative. Additionally or alternatively, this variation may include at least a portion (e.g. at least 5% of the height of the article along the rotational axis) where the second derivative $d^2\alpha/dD^2$ is positive or negative.

Preferably, the second support bears against the opposite (inner or outer) side of the workpiece compared with the forming tool. Thus, if the forming tool bears against the outer surface, preferably the second support bears against the inner surface and vice versa.

Similarly, in some embodiments, it is preferred that the first support bears against the opposite (inner or outer) surface of the workpiece compared with the forming tool. However, it is not considered essential in all embodiments that the first and second supports bear against the same surface of the workpiece.

During spin forming, and/or in terms of the finished article, it is possible to define a proximal end and a distal end of the workpiece and/or of the finished article. The proximal end is closer than the distal end to a mounting region of the workpiece at which region the workpiece is rotatably mounted in the apparatus (e.g. by clamping), when considered along the rotation axis of the workpiece. Preferably, the first support is disposed proximally of the second support.

Preferably, there is provided a third support for bearing against the inner or outer surface of the workpiece. As with the first and second supports, the workpiece preferably rotates with respect to the first and second supports. Preferably, the third support is located distally of the first support. The third support is preferably located laterally of the second support.

Preferably, the second and third supports are laterally offset from the first support. More preferably, the second and third supports are laterally offset in opposite directions from the first support. This lateral offset from the first support may be substantially equal for the second and third supports. Preferably, the distance between the second and third supports is less than the distance between the first and second supports. Preferably, the distance between the second and third supports is less than the distance between the first and third supports. Preferably, the distance between the first and second supports is substantially equal to the distance between the first and third supports.

Thus, in some preferred embodiments, the first, second and third supports are disposed in a triangular configuration.

Depending on the required shape for the article, the second and/or third supports may be radially offset from the first support.

The present inventors have found, based on a careful analysis of known spin forming processes, that the mandrel used in known spin forming processes only makes contact with the workpiece at three main locations. These locations vary depending on the relative position of the forming tool on the workpiece, and depending on the rotation of the workpiece. Thus, the role of the mandrel can be taken by the supports used in the present invention. Furthermore, as explained below, it is possible to simulate the use of mandrels of different shapes, by appropriate control of the position of the internal supports. Thus, in general, it is preferred that the first, second and third supports are provided at least at the points of closest contact between the workpiece and a notional mandrel which would be required to form the article to the required shape from the workpiece using the forming toot.

The forming tool is preferably located in order to provide the required shape for the article. The forming tool may be located distally of the second and/or third support (e.g. where the angle $\alpha$ is less than 90°. However, in some embodiments, the angle $\alpha$ may (at least locally) be more than 90°, in which case the forming tool may be located proximally for the second and/or third support. The forming tool is typically radially offset from the second and/or third supports. The forming tool may be located substantially aligned with the first support. The second and/or third supports may be laterally offset from the forming tool.

Preferably, the forming tool includes at least one forming roller. Typically, the forming roller is rotatable with respect to a forming roller arm. The use of a forming roller reduces frictional losses between the forming tool and the rotating workpiece. Preferably, the forming tool is positionable with respect to the rotating workpiece under machine control. Typically, this machine control is computer numerical control (CNC). Using such an approach allows the position of the forming tool to be very precisely controlled at high speeds, so that the forming tool can follow a required path around the workpiece at speeds corresponding to the rotational speed of the workpiece. Preferably, the position of the forming tool is controllable in the proximal-distal direction (parallel to the rotational axis of the workpiece), and/or in the radial direction, and/or in the lateral direction (perpendicular to the radial direction and to the proximal-distal direction).

Preferably, the first support includes at least one first support roller. Typically, the first support roller is rotatable with respect to a first support roller arm. The use of a first support roller reduces frictional losses between the first support and the rotating workpiece. Preferably, the first support is positionable with respect to the rotating workpiece under machine control. Typically, this machine control is computer numerical control (CNC). Using such an approach allows the position of the first support to be very precisely controlled at high speeds, so that the first support can follow a required path around the workpiece at speeds corresponding to the rotational speed of the workpiece. Preferably, the position of the first support is controllable in the proximal-distal direction (parallel to the rotational axis of the workpiece), and/or in the radial direction, and/or in the lateral direction (perpendicular to the radial direction and to the proximal-distal direction).

Preferably, the second support includes at least one second support roller. Typically, the second support roller is rotatable with respect to a second support roller arm. The use of a second support roller reduces frictional losses between the second support and the rotating workpiece. Preferably, the second support is positionable with respect to the rotating workpiece under machine control. Typically, this machine control is computer numerical control (CNC). Using such an approach allows the position of the second support to be very precisely controlled at high speeds, so that the second support can follow a required path around the workpiece at speeds corresponding to the rotational speed of the workpiece. Preferably, the position of the second support is controllable in the proximal-distal direction (parallel to the rotational axis of the workpiece), and/or in the radial direction, and/or in the lateral direction (perpendicular to the radial direction and to the proximal-distal direction).

Preferably, the third support includes at least one third support roller. Typically, the third support roller is rotatable with respect to a third support roller arm. The use of a third support roller reduces frictional losses between the third support and the rotating workpiece. Preferably, the third support is positionable with respect to the rotating workpiece under machine control. Typically, this machine control is computer numerical control (CNC). Using such an approach allows the position of the third support to be very precisely controlled at high speeds, so that the third support can follow a required path around the workpiece at speeds corresponding to the rotational speed of the workpiece.

Preferably, the position of the third support is controllable in the proximal-distal direction (parallel to the rotational axis of the workpiece), and/or in the radial direction, and/or in the lateral direction (perpendicular to the radial direction and to the proximal-distal direction).

Preferably, the first support roller arm extends distally into the workpiece from a proximal structure. Similarly, preferably the second support roller arm extends distally into the workpiece from a proximal structure. Similarly, preferably the third support roller arm extends distally into the workpiece from a proximal structure. The proximal structures of the second and third support roller arm may be connected to each other, but it is preferred that the positions of the second and third supports are independently controllable.

In some embodiments, the process may correspond to a shear spinning process, in which the mandrel known from prior art shear spinning processes is replaced by the supports discussed above. In such a process, the thickness of the workpiece is typically reduced depending on the angle $\alpha$, as shown in equation (2):

$$t_1 = t_0 \sin \alpha \qquad \text{equation (2)}$$

It is possible for the shear spinning process to be carried out using the first, second and (optionally) third supports identified above. However, preferably, the shear spinning process further has a fourth support, the workpiece rotating with respect to the fourth support. Preferably, the fourth support is located substantially in register with the main forming tool. Thus, the fourth support is preferably distally located but axially aligned with the first support. Furthermore, the fourth support is preferably located between the second and third supports.

Suitable control of the fourth support allows the thickness of the workpiece to be varied during the forming process.

The fourth support typically comprises a fourth support roller, in a similar manner as set out with respect to the second and third supports, and is similarly preferably independently controllable.

The apparatus can also be used to carry out a tube forming process, by setting the angle $\alpha$ to be 0°.

In some preferred embodiments, the first and second supports bear against the inner surface of the workpiece. In this respect they can be regarded as first and second internal supports. The forming tool therefore preferably bears against the outer surface of the workpiece. Where the apparatus includes third and/or fourth supports, preferably these also bear against the inner surface of the workpiece. In this way, as discussed above, these preferred embodiments can provide more flexible forming procedures for manufacturing required article shapes.

The present inventors have realised that the present invention is not necessarily limited to the use of internal supports. It is possible instead to apply the forming tool to the inner surface of the workpiece. In that case, it is preferred that the second support bears against the outer surface of the workpiece. In this respect the second support can be regarded as a second external support. The first support may bear against the inner surface of the workpiece, depending on the required configuration. Where the apparatus includes third and/or fourth supports, preferably these also bear against the outer surface of the workpiece. This is of interest in the manufacture of more complex shapes, or in the manufacture of relatively flatter articles from a relatively more concave workpiece, e.g. the manufacture of sheet-like articles from cup-like workpieces.

In order to provide precise control of the shape of the workpiece during the process, some preferred embodiments of the invention utilise at least one sensor adapted to sense the shape of the workpiece during the process. A control system may be provided in order to provide feedback control in order to compare the measured workpiece geometry with the required (or calculated) workpiece geometry. Thus, there is provided a means for comparing a difference between the target workpiece shape and the actual workpiece shape. Where a significant difference is detected, the apparatus is controlled in order to reduce this difference. Suitable control may be control of the position of the forming tool and/or supports, speed of rotation of the workpiece, etc.

The inventors consider that this type of control is not necessarily limited to spin forming processes.

Accordingly, in a further aspect of the invention, there is provided a sheet metal forming process in which a sheet metal workpiece is deformed from an initial configuration towards a final configuration using a sheet metal forming apparatus, wherein the sheet metal forming apparatus includes at least one sensor, the process including sensing the shape of the workpiece using the sensor during the deformation from the initial configuration towards the final configuration, comparing the sensed shape of the workpiece with a required (or calculated) shape of the workpiece, and controlling the apparatus to decrease a difference between the sensed shape of the workpiece with a required (or calculated) shape of the workpiece.

In a further aspect of the invention, there is provided a sheet metal forming apparatus for deforming a sheet metal workpiece from an initial configuration towards a final configuration, the apparatus having:

at least one sensor adapted to sense the shape of the workpiece using the sensor during the deformation from the initial configuration towards the final configuration; and a control system adapted to compare the sensed shape of the workpiece with a required (or calculated) shape of the workpiece, and to control the apparatus to decrease a difference between the sensed shape of the workpiece with a required (or calculated) shape of the workpiece.

Further preferred features of the invention are set out below.

BRIEF DESCRIPTION OF THE DRAWINGS

Preferred embodiments of the invention are described below, with reference to the following drawings.

DETAILED DESCRIPTION OF THE PREFERRED EMBODIMENTS, FURTHER OPTIONAL FEATURES OF THE INVENTION

The preferred embodiments of the invention provide a modified spin forming process. In this disclosure, the term "spin forming" is used interchangeably with "metal spinning" although it is acknowledged that the preferred embodiments may work with starting materials other than metal, e.g. ductile plastics materials. However, in the most preferred embodiments of the invention, the starting material is a metallic material, typically sheet metal.

In the preferred embodiments of the present invention, there is provided a flexible spin forming process, in which the role of the mandrel is provided by a suitable arrangement of internal support rollers. This also allows, where desired, for the manufacture of non-axisymmetric components.

Figure 7:
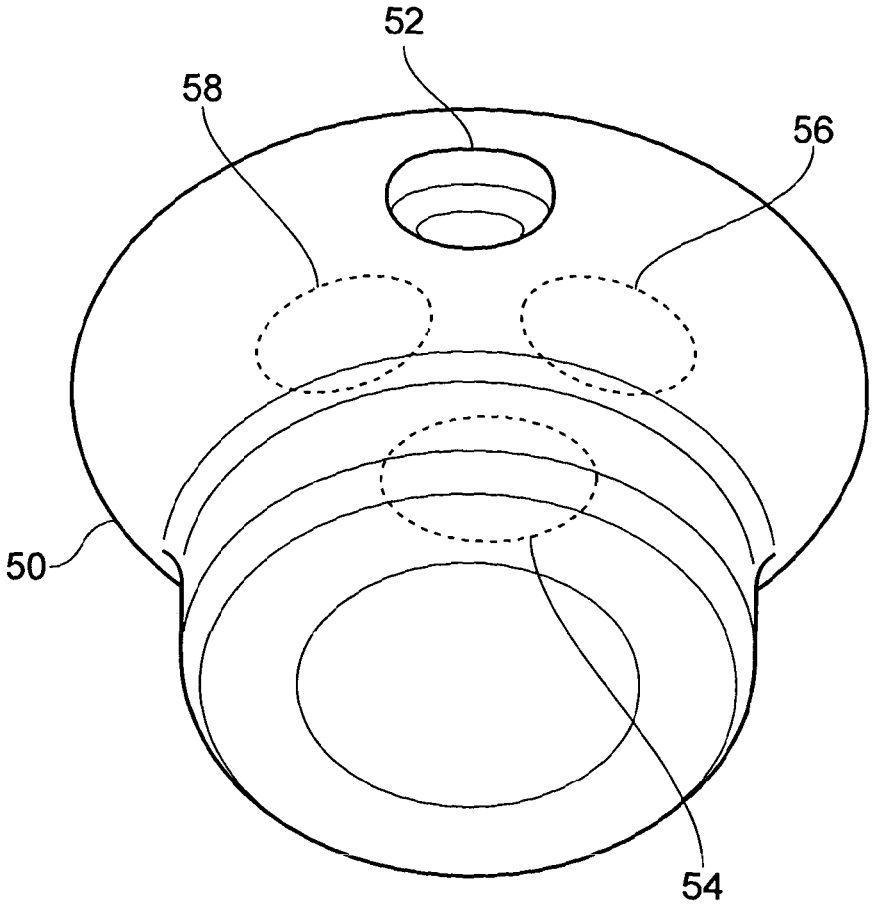
FIG. 7 illustrates the results of finite element modelling of a spin forming process.

With reference to FIG. 7, finite element modelling of a spin forming process of a work piece 50 using forming roller 52 reveals that the work piece 50 contacts the mandrel at only 3 locations, for each position of roller 52 with respect to work piece 15. These are: first location 54 located proximal to the rotatable mounting position of the work piece and axially aligned with roller 52; and second 56 and third 58 locations, each spaced distally from the first location and offset laterally from the first location and the position of roller 52.

According to a preferred embodiment of the invention, the mandrel can therefore be replaced using a corresponding arrangement of internal supports, the work piece being allowed to rotate with respect to the internal supports.

Figure 5:
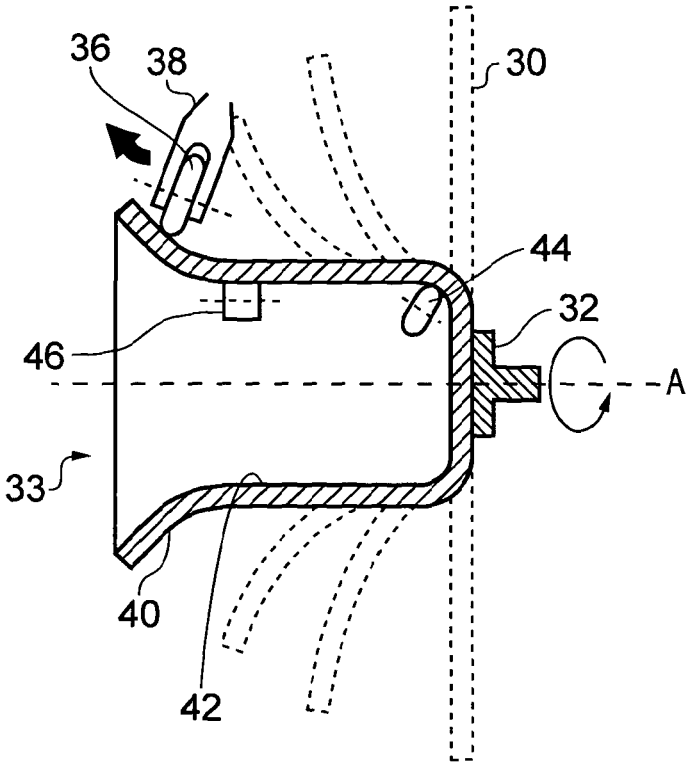
FIG. 5 shows a schematic sectional view (parallel to the axis of rotation) of a spin forming process and apparatus according to an embodiment of the invention.
Figure 6:
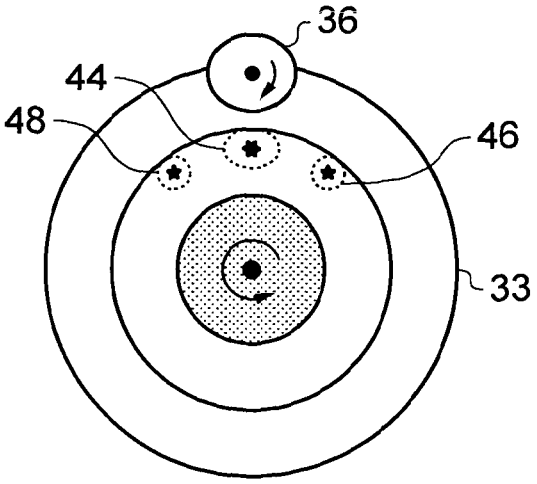
FIG. 6 shows a schematic end view (perpendicular to the axis of rotation) of the spin forming process and apparatus of FIG. 5.

FIG. 5 shows a schematic sectional view (parallel to the axis of rotation) of a spin forming process and apparatus according to a preferred embodiment of the invention. FIG. 6 shows a schematic end view of this embodiment. In these drawings, initial work piece 30 is formed of sheet metal. During the process, this initial work piece is gradually deformed towards the desired final shape of article 33. Work piece 30 is rotatably held by tailpiece 32 for rotation about rotational axis A. Forming roller 36 is rotatably held by forming roller arm 38 and bears against outer surface 40 of the work piece.

An arrangement of internal support rollers bears against the internal surface 42 of the work piece. First internal support roller 44 (also referred to herein as a blending roller) is provided proximal to the tail stock end of the article 33. Second 46 (and third 48—see FIG. 6) internal support rollers are provided distally from the first internal support roller 44 and laterally offset from the first internal support roller 44. The forming roller 36 is distally spaced from the first, second and third internal support rollers but is not laterally offset from the first internal support roller 44.

The configuration illustrated in FIGS. 5 and 6 has two main advantages compared to a conventional spinning process. Firstly, the configuration is flexible as there is no need for a specific mandrel for each desired shape of the finished article. Secondly, where it is possible to control the movement of the rollers radially (and, optionally, laterally), in addition to allowing movement parallel to the axis of rotation, means that production of non-axisymmetric articles is possible.

Figure 8:
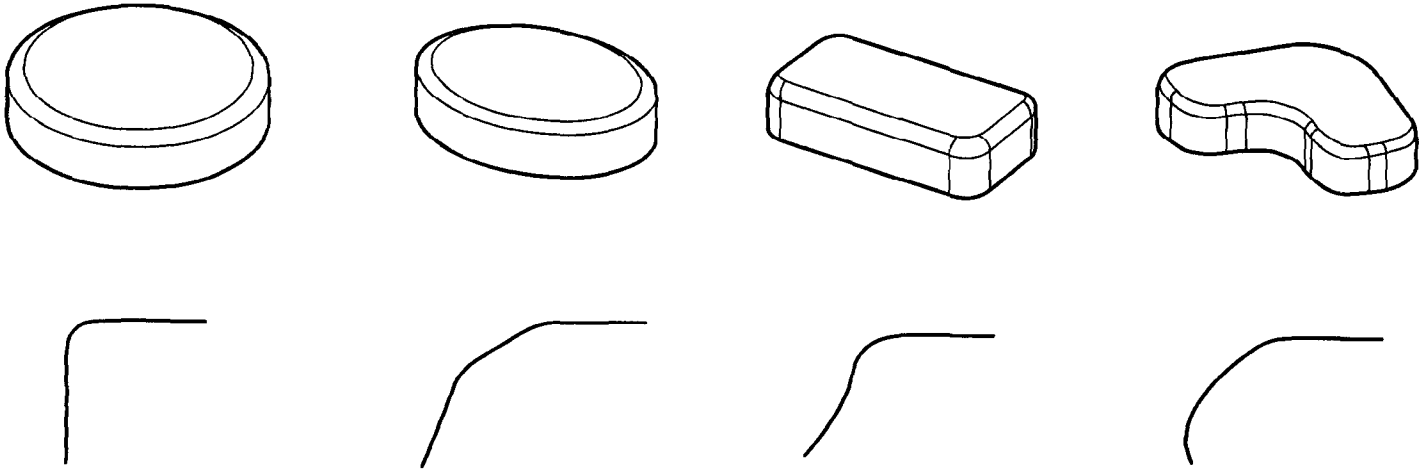
FIG. 8 shows some three dimensional shapes and wall profiles that can be formed using embodiments of the invention.

FIG. 8 shows some examples of three dimensional shapes of different complexity that are possible using the preferred embodiment of the invention. A circular cup can be formed using the present invention but also using conventional spin forming. However, an elliptical cup and a rectangular cup cannot be formed by conventional spin forming. Furthermore, a kidney bean shaped cup is a highly complex shape, having a cross section including a re-entrant. This shape is also possible using preferred embodiments of the invention.

FIG. 8 also shows wall profiles that can be formed using embodiments of the invention. The linear profile can be formed using conventional spin forming. The linear stepped profile can also be formed by conventional spin forming, as can the second order profile. However, of course, specific mandrel shapes must be generated for such processes. It is more difficult to form the re-entrant profile shown in FIG. 8 using conventional spin forming, since a suitably-shaped mandrel would be difficult to remove from the finished product. Such shapes can be formed in a straightforward manner using the preferred embodiments of the present invention, since the internal supports provide the required mandrel-like support, but control of their position allows these complex shapes to be formed.

Figure 9:
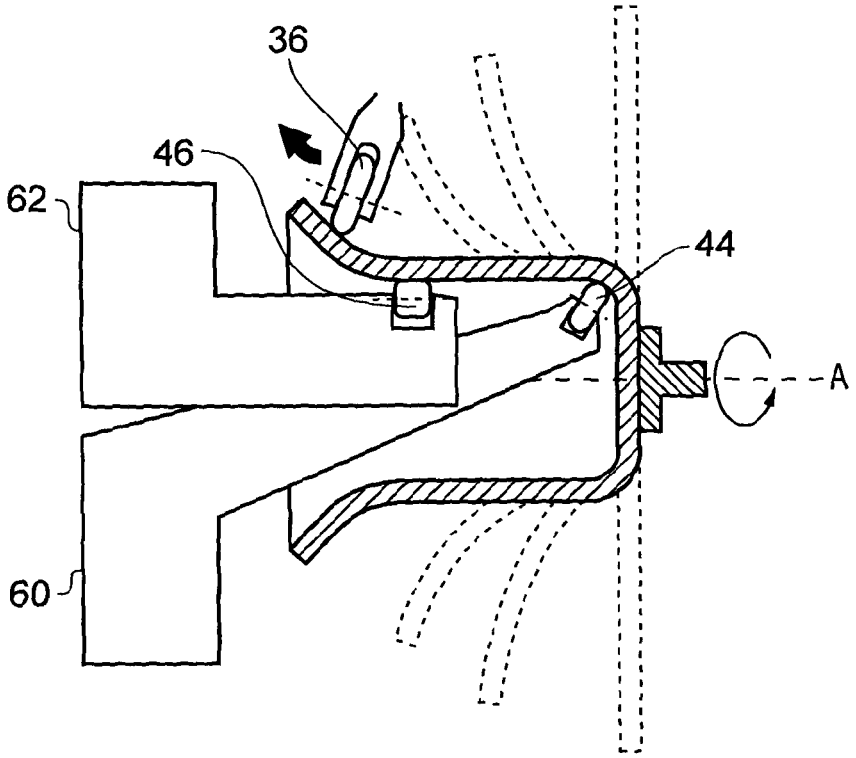
FIGS. 9 and 10 show views corresponding to FIGS. 5 and 6, incorporating the blending roller (first internal support roller) arm and the support roller (second and third internal support roller) arms.
Figure 10:
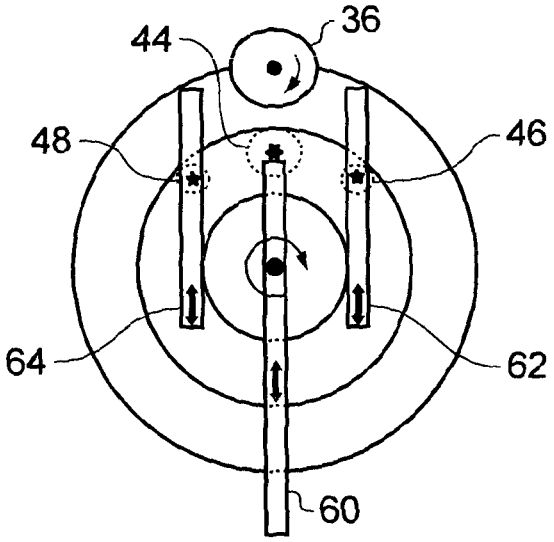

FIGS. 9 and 10 show views corresponding to FIGS. 5 and 6, but show blending roller arm 60 and support roller arms 62, 64. The linear arrows in FIG. 10 indicate that blending roller arm 60 and support roller arms 62, 64 can be controlled to move parallel to the rotational axis A. In addition to this, in preferred embodiments, blending roller arm 60 and support roller arms 62, 64 can be moved radially, in order to provide corresponding control of the position of the internal support rollers. Furthermore, in still further preferred embodiments, blending roller arm 60 and support roller arms 62, 64 can additionally be moved laterally (i.e. in a direction perpendicular to rotational axis A and perpendicular to the radial direction, in order to provide precise positioning of the internal support rollers at the required locations for suitable support of the internal surface of the work piece. Reference here to the 'lateral' direction encompasses control of the support roller arms 62, 64 in order to adjust the rotational angle between support roller arms 62, 64, thus 'lateral offset' has the same meaning here as 'circumferential offset'.

Control of the rotational speed of the work piece, the position of forming roller 36 and the positions of the internal support rollers 44, 46 and 48 is typically provided by computer numerical control (CNC), in a manner which will be understood by the skilled person.

FIGS. 11-15 show views of a complete apparatus according to an embodiment of the invention.

Figure 11:
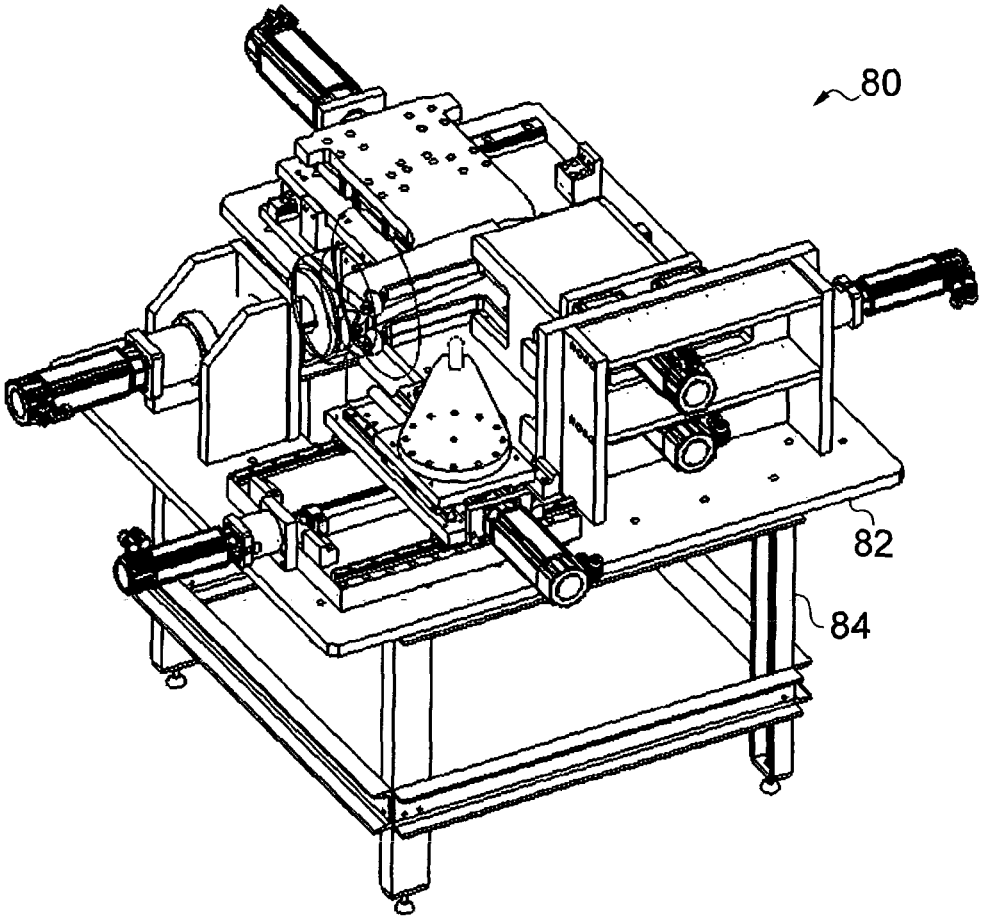
FIG. 11 shows a schematic isometric view of an assembled apparatus according to an embodiment of the invention.
Figure 12:
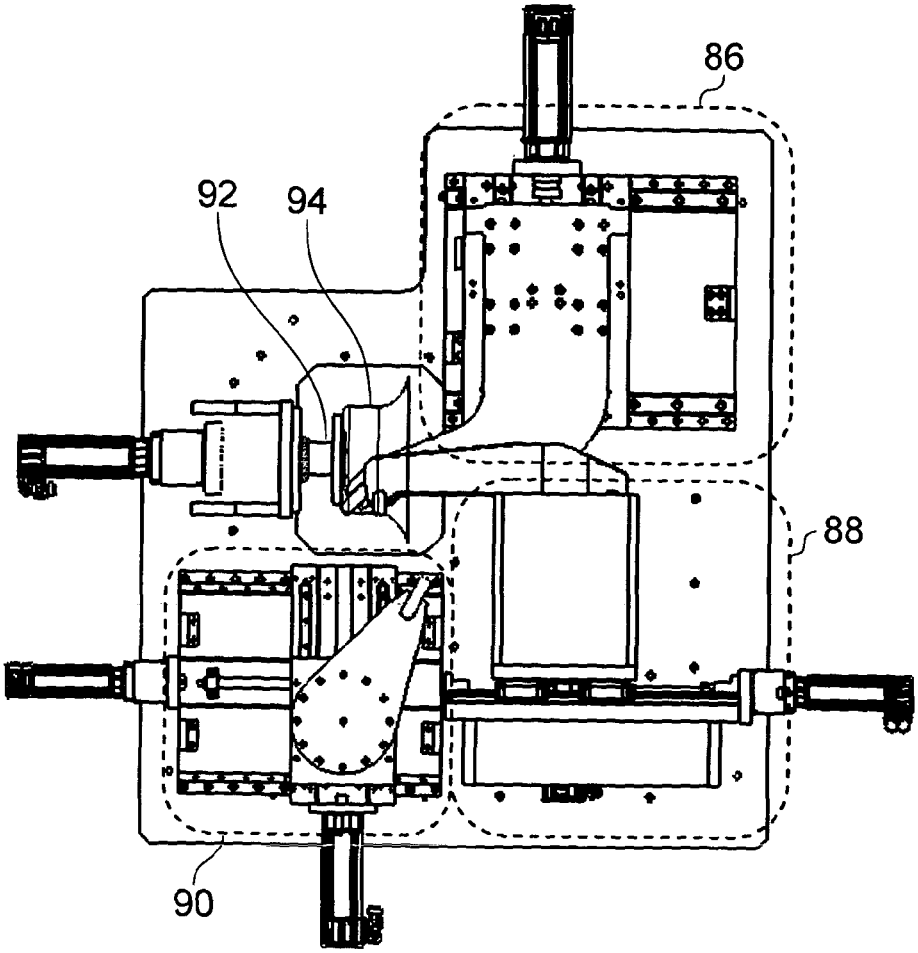
FIG. 12 shows a plan view of the apparatus of FIG. 11.

FIG. 11 shows a schematic isometric view of an assembled apparatus 80 according to an embodiment of the invention. The apparatus is supported on base plate 82 which is in turn supported on a supporting frame 84. FIG. 12 shows a plan view of the apparatus 80. Work piece 94 is rotatably supported by spindle 92. Three identifiable modules interact with work piece 94. These are blending roller module 86, support roller module 88 and forming roller module 90. These are described in more detail with reference to FIGS. 13-15.

Figure 13:
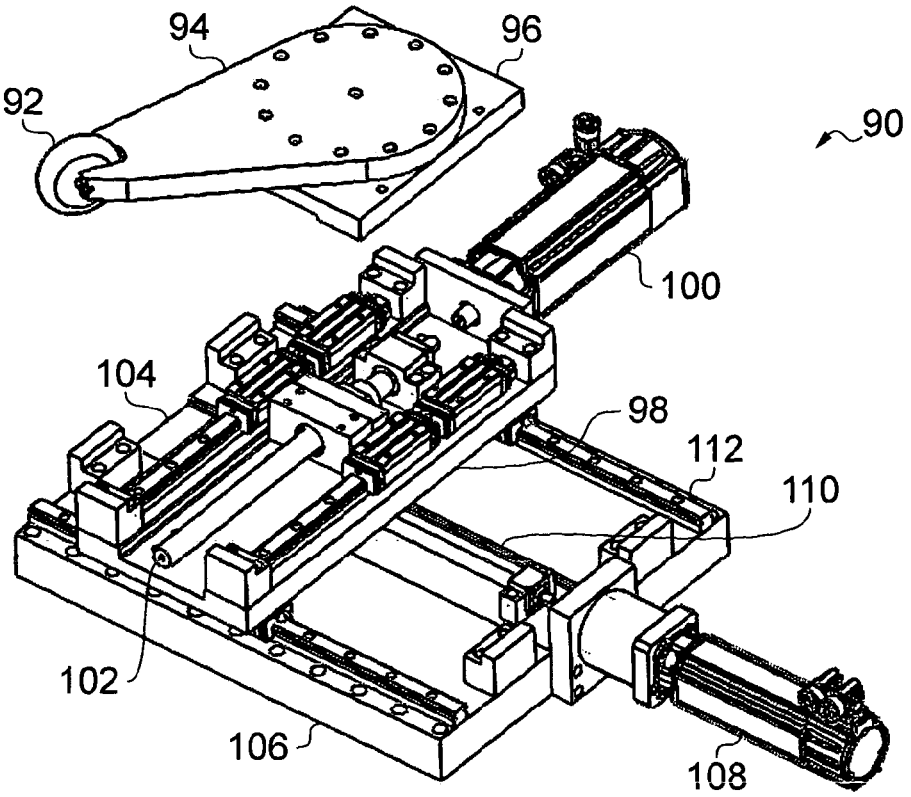
FIG. 13 shows a view of a forming roller module for use in the apparatus of FIG. 11.
Figure 14:
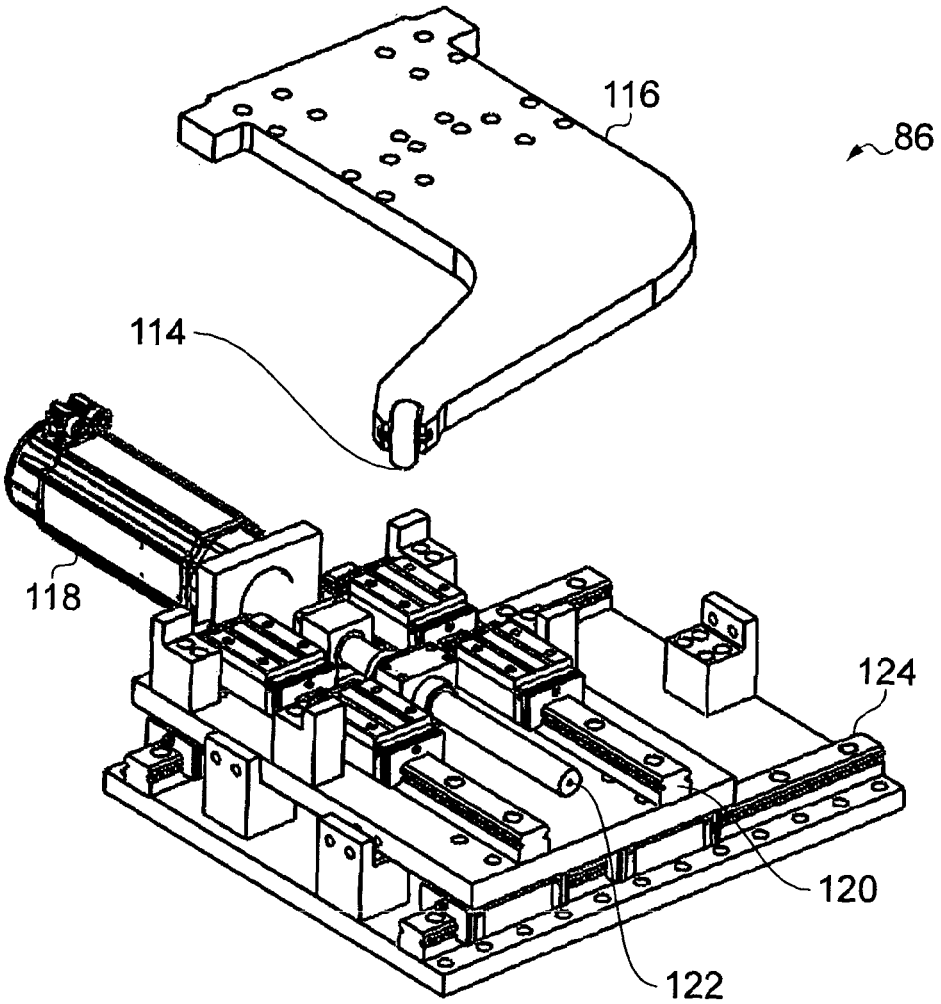
FIG. 14 shows a view of a blending roller (first internal support roller) module for use in the apparatus of FIG. 11.

FIG. 13 shows forming roller module 90. Forming roller 92 is rotatably supported by forming roller arm 94. Forming roller arm 94 is rigidly attached to forming roller arm plate 96. Forming roller arm plate 96 is shown removed from radial positioning means 98 however, in use, forming roller arm plate 96 is attached to radial positioning means 98. The radial position of forming roller 92 can be adjusted by suitable control of radial motor 100 in combination with radial ballscrew and radial linear guide 104 radial positioning means 98 is in turn supported on axial positioning means 106 the axial position of forming roller 92 is therefore controlled by suitable control of axial motor 108, axial ballscrew 110 and axial linear guide 112. FIG. 14 shows the blending roller module 86. In this embodiment, radial motion of the blending roller 114 is motorised but axial motion of blending roller 114 is manually controlled. In further preferred embodiments, the axial motion of the blending roller may be under motorised control, implemented in a manner which will be understood by the skilled person.

Figure 15:
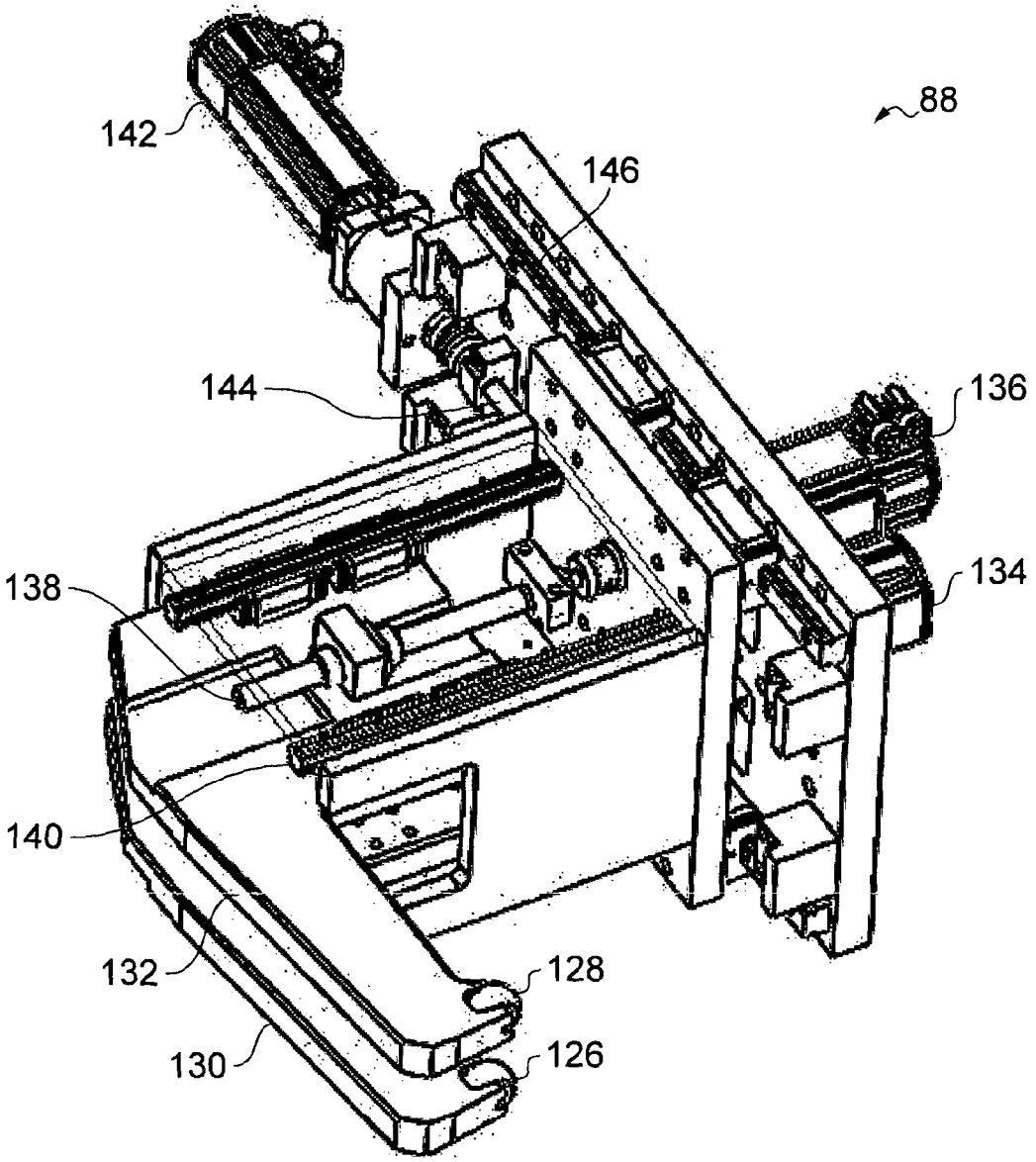
FIG. 15 shows a view of a support roller (second and third internal support roller) module for use in the apparatus of FIG. 11.

In FIG. 14, blending roller 114 is held on blending roller arm 116 radial movement of blending roller 114 is controlled by suitable control of radial motor 118 in combination with radial linear guide 120 and radial ballscrew 122. Axial linear guide 124 provides control of the axial position of blending roller 114. FIG. 15 shows support roller module 88 second and third internal support rollers 126, 128 are rotatably mounted with respect to respective internal support roller arms 130, 132. Radial position of the second and third internal support rollers 126, 128 is provided independently by radial motors 134, 136 radial ballscrew 138 and radial linear guide 140 are shown only with respect to radial motor 136. Axial position of second and third internal support rollers 126, 128 is provided in this embodiment by single axial motor 142 and corresponding axial ballscrew 144 and linear guide 146. In alternative embodiments, the linear position of second and third internal support rollers 126, 128 can be provided independently, by providing independent corresponding axial motors, ballscrews and linear guides as will be apparent to the skilled person.

Using appropriate control of the positions of the various rollers in the apparatus of FIGS. 11-15, work piece 94 can be subjected to spin forming, forming roller 92 bearing against the outer surface of the work piece and blending roller 114 and second and third internal support rollers 126, 128 bearing against the inner surface of the work piece, in place of a mandrel. Accordingly, the shape of the article formed can be varied from run to run of the apparatus, without the need for different mandrels, only requiring suitable numerical control of the position of the rollers. Furthermore, non-axisymmetric articles can be manufactured as discussed above.

Figure 1:
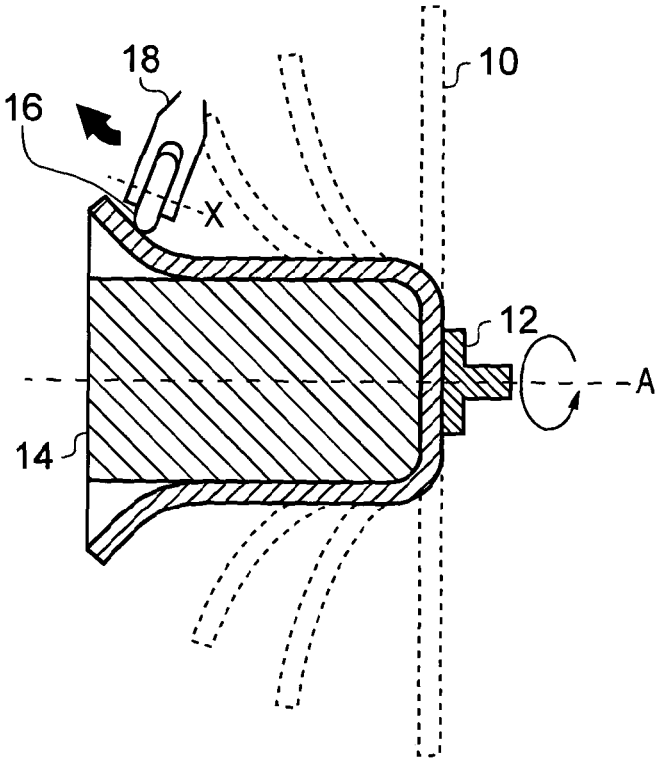
FIG. 1 illustrates a known conventional spin forming process.
Figure 2:
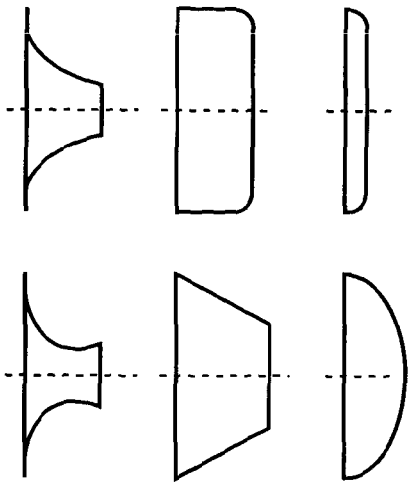
FIG. 2 shows the typical axisymmetric shapes that can be formed using the process of FIG. 1.
Figure 3:
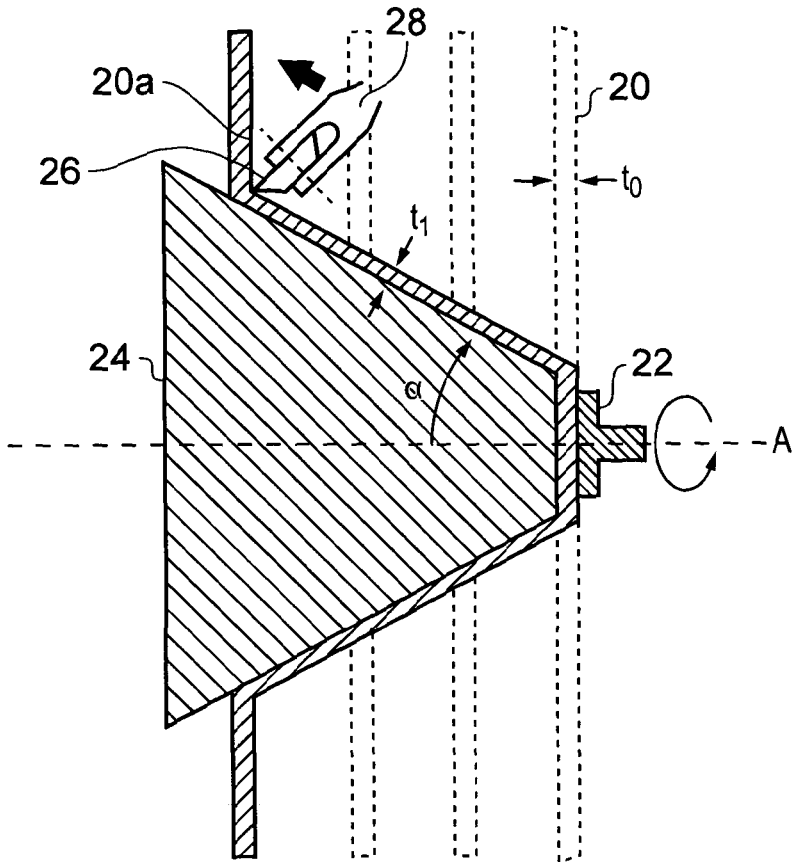
FIG. 3 illustrates a known shear spinning process.
Figure 4:
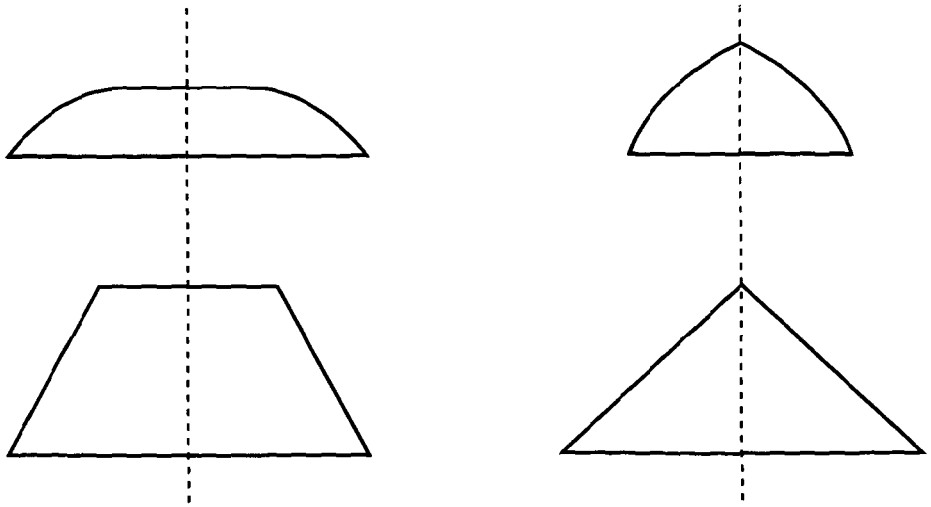
FIG. 4 shows the typical axisymmetric shapes that can be formed using the process of FIG. 3.

The present inventors have also realised that embodiments of the present invention can be used to carry out shear spinning and/or tube forming processes. FIG. 3 illustrates a conventional shear spinning process. There are three main differences from a conventional spinning process: there is a change in thickness dictated by the wall angle ($\alpha$); shear spinning is carried out in a single pass, the roller following the mandrel profile; and the shear spinning roller (forming tool) has a sharp radius at its tip.

Thus, in further embodiments of the invention, a shear spinning process is provided, in which a mandrel is replaced by rollers. There are different options for this. In one embodiment, illustrated in FIGS. 16 and 17, workpiece 230 is supported at the internal surface by first internal support roller 244 located close to mandrel 232, and second 246 and third 248 internal support rollers located distally of the first internal support roller 244. Second 246 and third 248 internal support rollers are offset laterally from each other. Main forming roller 236 is held by forming arm 238. The main forming roller is a shear spinning roller—with a sharp 'nose' radius at the end. During the process, the second and third support rollers move together with the main forming roller, both radially and axially, with a radial offset from the main forming roller equal to the final thickness of the workpiece. It is possible for the toolpath to be a single pass, but this is not necessarily essential. In other embodiments, the thickness of the workpiece can be reduced in stages, to reduce the roller arm forces.

The inventors consider that in the shear spinning embodiments of the present invention, careful control of toolpath is important. The shear spinning toolpath is more 'aggressive' than conventional spinning embodiments and consist of mainly straight lines.

Figure 16:
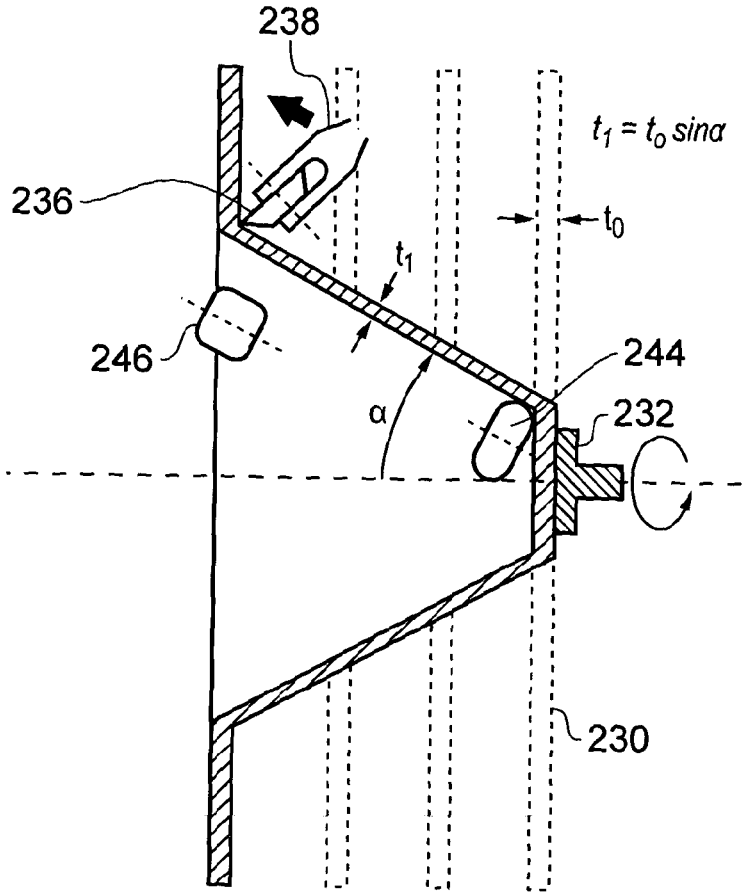
FIG. 16 shows a schematic sectional view (parallel to the axis of rotation) of a spin forming process and apparatus according to another embodiment of the invention.
Figure 17:
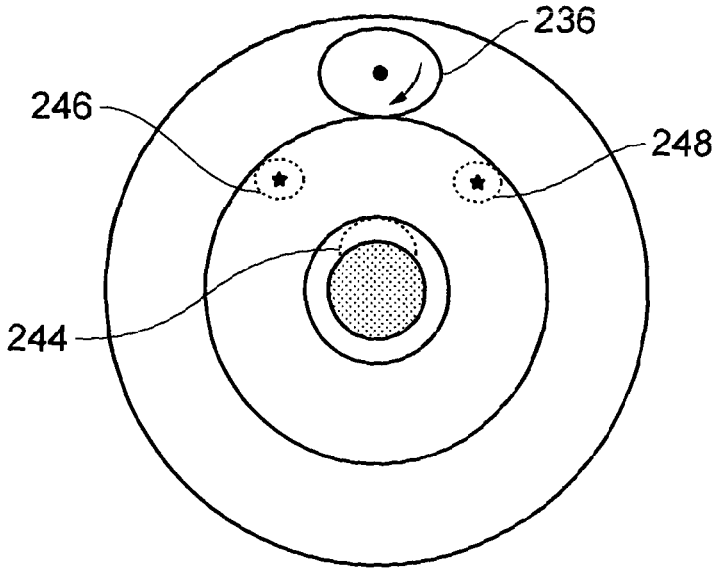
FIG. 17 shows a schematic end view (perpendicular to the axis of rotation) of the spin forming process and apparatus of FIG. 16.
Figure 18:
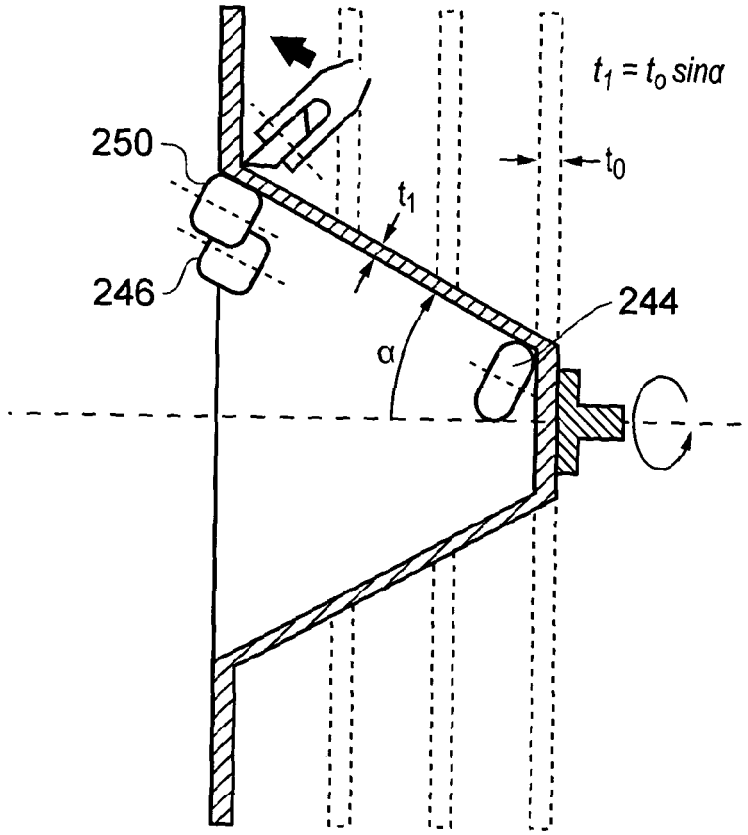
FIGS. 18 and 19 show a modified embodiment based on FIGS. 16 and 17 respectively.
Figure 19:
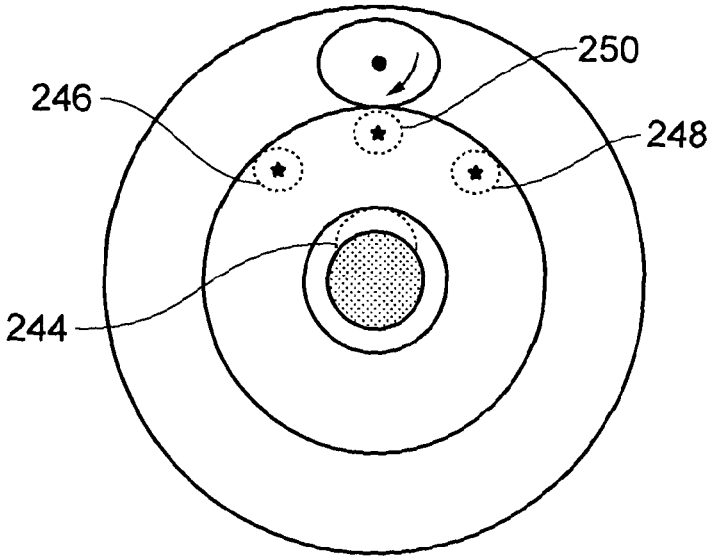

FIGS. 18 and 19 illustrate another embodiment of the invention, which is a modification of the embodiment illustrated in FIGS. 16 and 17. Therefore similar features are not described again here, and similar reference numbers are used for similar features. In this embodiment, a fourth internal support roller 250 is added. This is positioned directly under the main forming roller, to provide better control over final thickness of the workpiece. Fourth internal support roller 250 is therefore located distally from the first internal support roller 244, but is axially aligned with it, and has the second and third internal support rollers 246, 248 laterally offset on either side of it. It is noted that this configuration exerts high forces on the roller arms, so a relatively stiff machine is typically required.

It is noted here that an apparatus having four internal support rollers, in the manner indicated in FIGS. 18 and 19 can be operated in conventional spinning or shear spinning 'mode', typically by controlling the operation of the fourth internal support roller in order to control the thickness of the workpiece. In some embodiments, the fourth internal support roller could be switched in and out of use during a single process for manufacturing a component. This allows control in order to achieve a variation in the thickness of the final workpiece.

In a further embodiment, it is possible to use the apparatus with four internal support rollers in order to carry out tube spinning, with wall angle set to $\alpha=0°$. It is again noted that this configuration exerts high forces on the roller arms, so a relatively stiff machine is typically required.

Figure 20:
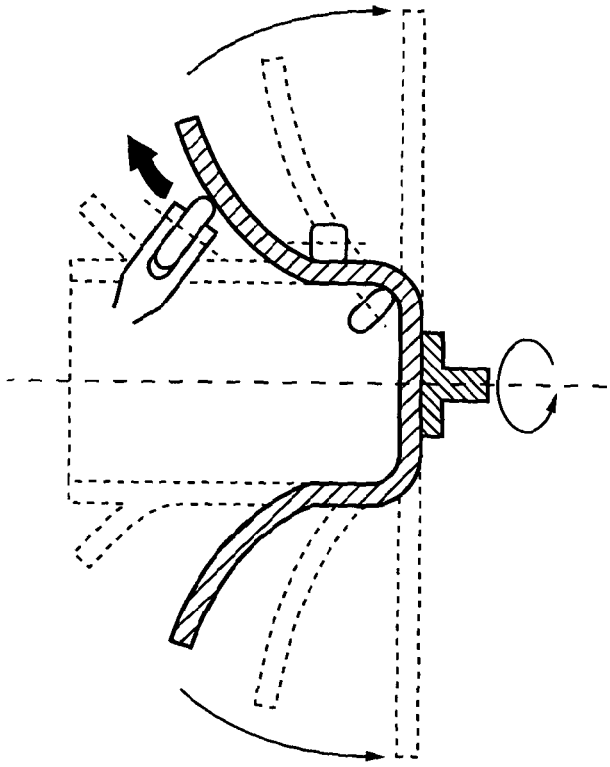
FIGS. 20 and 21 show a modified embodiment based on FIGS. 5 and 6 respectively.
Figure 21:
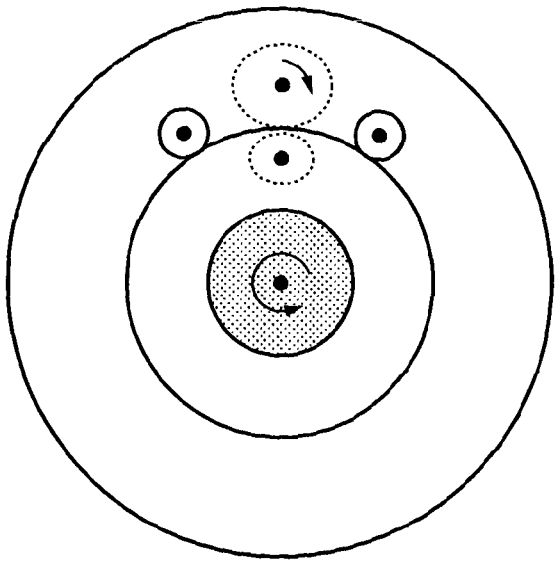

The present inventors have also realised that the present invention can be used with the forming tool bearing against the inner surface of the workpiece. In an embodiment based on conventional spinning, this is illustrated in FIGS. 20 and 21, showing the spin forming of a cup-shaped workpiece into a flat plate using an internal forming tool, an internal support and an external support.

A similar approach can be set out with respect to shear spinning. This is illustrated in FIGS. 22 and 23, in which an internal shear spinning forming tool is used, with an internal first support roller and external second, third and fourth support rollers.

Figure 22:
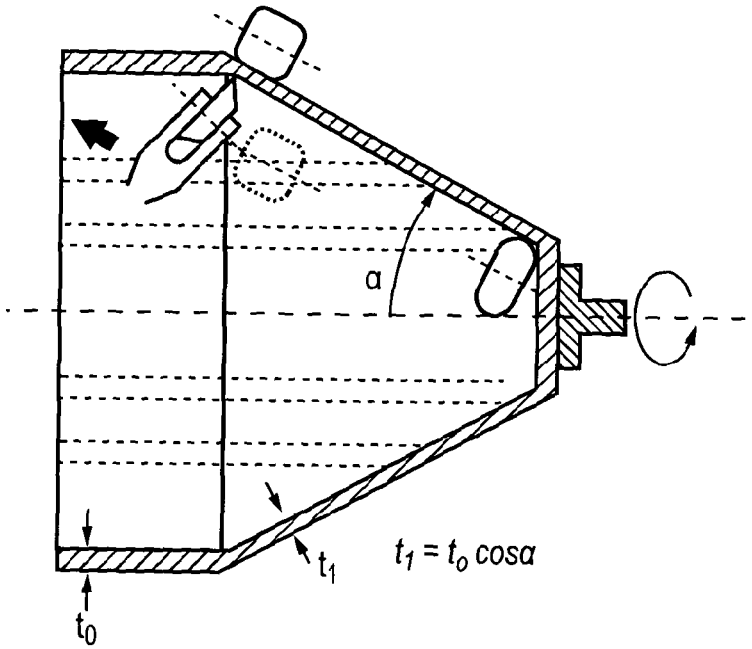
FIGS. 22 and 23 show a modified embodiment based on FIGS. 18 and 19 respectively.
Figure 23:
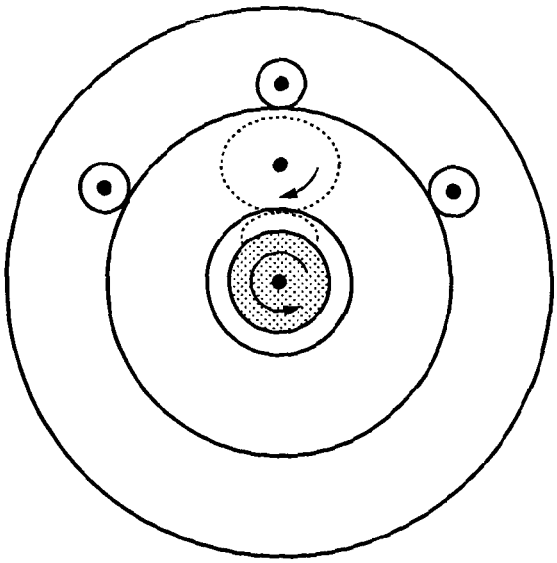

The approach shown in FIGS. 22 and 23 shows how the process based on conventional spin forming can be combined with the process based on shear spinning. In FIG. 22, the workpiece is first formed into a cup shape using the process based on conventional spin forming. Then the workpiece is subjected to shear spin forming using an internal forming tool. This allows the thickness of the workpiece to be reduced.

Thus, forming in both directions can be used to manufacture lightweight components. Carrying out combined spin forming (i.e. based on both conventional and shear spin forming), it is possible to produce components with varying wall thickness in a single component. The thickness can be structurally optimised, allowing the production of structurally optimised, lightweight components.

As an example, it is possible to manufacture a 45 degree cone with varying thickness (along the axis). This is done by first shear-spinning a component with varying wall angle to obtain varying thickness along the wall. Then, 'reverse' conventional spinning is carried out (using an internal forming tool and external second and third support rollers) to 'straighten' the workpiece back to 45 degrees. Since conventional spinning preserves existing thickness, the combined result of this process would give 45 degree cone with varying thickness.

In order to provide precise control of the shape of the workpiece during the process, preferred embodiments of the invention utilise at least one sensor (not shown) adapted to sense the shape of the workpiece during the process. A control system may be provided in order to provide feedback control in order to compare the measured workpiece geometry with the required (or calculated) workpiece geometry. Thus, there is provided a means for comparing a difference between the target workpiece shape and the actual workpiece shape. Where a significant difference is detected, the apparatus is controlled in order to reduce this difference. Suitable control may be control of the position of the forming tool and/or supports, speed of rotation of the workpiece, etc.

The preferred embodiments of the invention have been described by way of example. On reading this disclosure, modifications to these embodiments, further embodiments and modifications thereof will be apparent to the skilled person and accordingly fall within the scope of the present invention.

The invention claimed is:

1. A spin forming process for manufacturing an article of a required shape from a workpiece, the workpiece having, with reference to the required shape of the article, an outer surface and an inner surface, wherein the process comprises:

mounting the workpiece at a mounting region, there being defined a proximal end of the workpiece and a distal end of the workpiece, the proximal end of the workpiece being closer than the distal end of the workpiece to the mounting region of the workpiece;

rotating the workpiece with respect to a forming tool, the forming tool bearing against one of the outer and inner surfaces of the workpiece to deform the workpiece towards the required shape, the forming tool comprising a forming roller having a width in a direction parallel to a rotation axis of the forming roller;

providing a first support which bears against the opposite surface of the workpiece compared with the forming tool, the first support comprising a first support roller having a width in a direction parallel to a rotation axis of the first support roller, the workpiece rotating with respect to the first support; and providing a second support which bears against the opposite surface of the workpiece compared with the forming tool, the second support comprising a second support roller having a width in a direction parallel to a rotation axis of the second support roller, the workpiece rotating with respect to the second support, the rotation of the workpiece being about a workpiece rotation axis defining an axial direction of the workpiece, and wherein the rotation of the workpiece further defines a radial direction of the workpiece perpendicular to the axial direction of the workpiece, and wherein the first support is disposed proximally of the second support and the forming tool is disposed distally of the second support so that no overlap occurs between the width of the forming roller and the width of the second support roller in at least one of the axial direction of the workpiece and the radial direction of the workpiece.

2. The spin forming process according to claim 1 wherein the thickness of the workpiece is substantially unchanged when the required shape of the article is formed.

3. The spin forming process according to claim 1 wherein an initial thickness of the workpiece is $t_0$ and a final thickness of the workpiece is $t_1$, and inequality (1) is satisfied, for values of $\alpha$ less than 90°:

$$t_1 > t_0 \sin \alpha \qquad \text{inequality (1)}$$

wherein angle $\alpha$ as the angle between the rotational axis A of the workpiece and the tangent to the internal surface of the workpiece, the tangent being drawn in a plane containing the rotational axis A of the workpiece.

4. The spin forming process according to claim 1 wherein the required shape of the article is an axisymmetric shape.

5. The spin forming process according to claim 1 wherein the required shape of the article is a non-axisymmetric shape.

6. The spin forming process according to claim 1 wherein there is provided a third support for bearing against the same surface of the workpiece as the second support and the workpiece rotates with respect to the third support.

7. The spin forming process according to claim 6 wherein the third support is located distally of the first support and laterally of the second support.

8. The spin forming process according to claim 6 wherein the second and third supports are laterally offset from the first support.

9. The spin forming process according to claim 6 wherein the first, second and third supports are provided at least at the points of closest contact between the workpiece and a notional mandrel which would be required to form the article to the required shape from the workpiece using the forming tool.

10. The spin forming process according to claim 6 wherein there is provided a fourth support, the workpiece rotating with respect to the fourth support, the fourth support being located substantially in register with the forming tool.

11. The spin forming process according to claim 10 wherein the fourth support is controlled to vary the thickness of the workpiece during the forming process.

12. The spin forming process according to claim 10, wherein the process is a shear spinning process or a tube spinning process.

13. The spin forming process according to claim 6 wherein the forming tool is disposed distally of the third support.

14. The spin forming process according to claim 7 wherein one or more of the first, second and third supports are independently positionable under machine control with respect to the rotating workpiece.

15. The spin forming process according to claim 8 wherein one or more of the first, second and third supports are independently positionable under machine control with respect to the rotating workpiece.

16. The spin forming process according to claim 1 wherein the forming tool is positionable under machine control with respect to the rotating workpiece.

17. The spin forming process according to claim 1 wherein one or more of the first and second supports are independently positionable under machine control with respect to the rotating workpiece.

18. The spin forming process according to claim 1 wherein the forming tool bears against the outer surface of the workpiece and the first and second supports bear against the inner surface of the workpiece.

19. The spin forming process according to claim 1 wherein the forming tool bears against the inner surface of the workpiece and the first and second supports bear against the outer surface of the workpiece.

20. An apparatus for manufacturing an article of a required shape from a workpiece by spin forming, the workpiece having, with reference to the required shape of the article, an outer surface and an inner surface, the apparatus comprising:

a base;

a rotatable workpiece mount operatively associated with the base, the rotatable workpiece mount providing for rotatable mounting of the workpiece in the apparatus at a mounting region of the workpiece, there being defined a proximal end of the workpiece and a distal end of the workpiece, the proximal end of the workpiece being closer than the distal end of the workpiece to the mounting region of the workpiece;

a forming tool operatively associated with the base for bearing against one of the outer and inner surfaces of the workpiece to deform the workpiece towards the required shape, the forming tool comprising a forming roller having a width in a direction parallel to a rotation axis of the forming roller;

a first support operatively associated with the base for bearing against the opposite surface of the workpiece compared with the forming tool, the first support comprising a first support roller having a width in a direction parallel to a rotation axis of the first support roller; and a second support operatively associated with the base for bearing against the opposite surface of the workpiece compared to the forming tool, the second support comprising a second support roller having a width in a direction parallel to a rotation axis of the second support roller, wherein the apparatus is operable to cause the workpiece to rotate with respect to the first and second supports, and wherein the rotation of the workpiece is about a workpiece rotation axis defining an axial direction of the workpiece, and wherein the rotation of the workpiece defines a radial direction of the workpiece perpendicular to the axial direction of the workpiece, the first support being disposed proximally of the second support and the forming tool being disposed distally of the second support so that no overlap occurs between the width of the forming roller and the width of the second support roller in at least one of the axial direction of the workpiece and the radial direction of the workpiece.

21. The apparatus according to claim 20 wherein there is provided a third support operatively associated with the base for bearing against one of the inner and outer surfaces of the workpiece, the apparatus being operable to allow the workpiece to rotate with respect to the third support.

22. The apparatus according to claim 21 wherein there is provided a fourth support operatively associated with the base, the workpiece rotating with respect to the fourth support, the fourth support being located substantially in register with the forming tool.

23. The apparatus according to claim 21 wherein the forming tool is disposed distally of the third support.

* * * * *